US007029531B2

(12) United States Patent
Weis

(10) Patent No.: US 7,029,531 B2
(45) Date of Patent: Apr. 18, 2006

(54) REWETTING INSTALLATION FOR A MATERIAL WEB

(75) Inventor: Anton Weis, Lorsch (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 3 days.

(21) Appl. No.: 10/485,112

(22) PCT Filed: Jul. 19, 2002

(86) PCT No.: PCT/DE02/02659

§ 371 (c)(1),
(2), (4) Date: Feb. 3, 2004

(87) PCT Pub. No.: WO03/016060

PCT Pub. Date: Feb. 27, 2003

(65) Prior Publication Data

US 2004/0173112 A1 Sep. 9, 2004

(30) Foreign Application Priority Data

Aug. 9, 2001 (DE) ..... 101 39 219

(51) Int. Cl.
*B05C 5/00* (2006.01)
*B05C 11/00* (2006.01)
*B41L 35/14* (2006.01)

(52) U.S. Cl. ..... 118/325; 118/46; 118/313; 118/69

(58) Field of Classification Search ..... 118/325, 118/77, 117–118, 122–123, 419, 234–235, 118/46, 69, 313; 101/488
See application file for complete search history.

(56) References Cited

U.S. PATENT DOCUMENTS

| | | | | |
|---|---|---|---|---|
| 6,001,421 | A * | 12/1999 | Ahonen et al. | 427/316 |
| 6,095,047 | A | 8/2000 | Dawley | |
| 6,299,685 | B1 * | 10/2001 | Siler et al. | 118/58 |
| 6,308,619 | B1 | 10/2001 | Dawley | |
| 6,569,288 | B1 * | 5/2003 | Linnonmaa et al. | 162/207 |

FOREIGN PATENT DOCUMENTS

| | | | |
|---|---|---|---|
| DE | 1101447 | | 3/1961 |
| DE | 3115958 | C2 | 12/1983 |
| DE | 4405332.0 | A1 | 8/1995 |
| DE | 19921632 | A1 | 1/2000 |
| DE | 19920091.2 | A1 | 11/2000 |

* cited by examiner

*Primary Examiner*—Chris Fiorilla
*Assistant Examiner*—Yewebdar Tadesse
(74) *Attorney, Agent, or Firm*—Jones, Tullar & Cooper, PC

(57) ABSTRACT

A rewetting installation is provided for use with a printed and dried material web. A wetting device applies a silicon emulsion to at least one of a first and second side of the material web. A second wetting device is located at a distance from the wetting device or devices which are used for the renewed application of the silicon emulsion to at least one side of the material web.

4 Claims, 1 Drawing Sheet

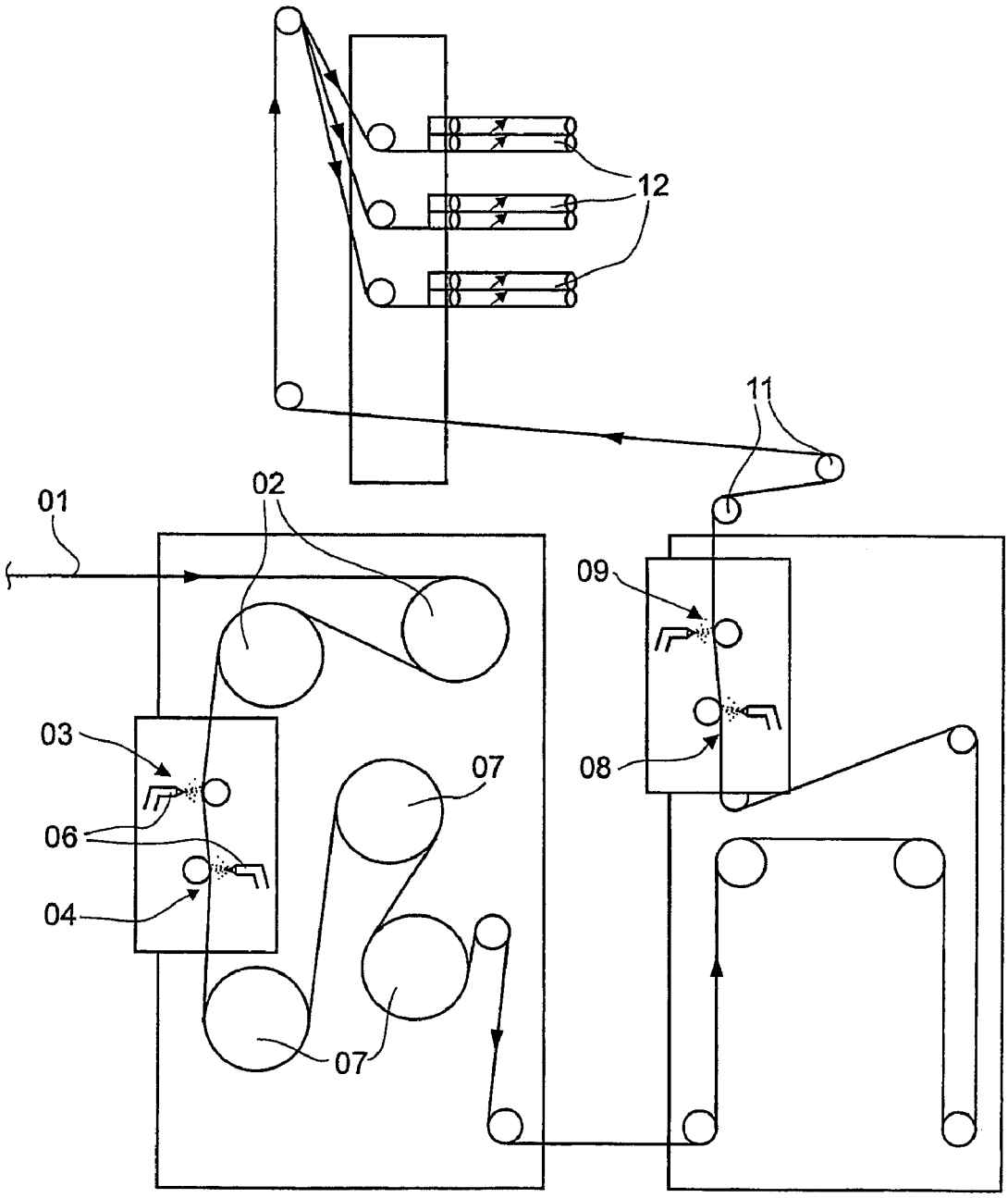
12
11
01
02
09
03
07
08
06
04
07

REWETTING INSTALLATION FOR A MATERIAL WEB

FIELD OF THE INVENTION

The present invention is directed to a re-moistening installation for a web of material and to a method for improving the running properties of a web of material. The web or material is moistened and re-moistened by separate, spaced devices.

BACKGROUND OF THE INVENTION

In high-speed printing presses, an imprinted paper web is often dried, by the application of heat, in order to set the printing ink and to prevent the smearing of otherwise possibly insufficiently dried ink on rollers over which the imprinted web is guided. However, this treatment results not only in the desired drying of the paper surface, but also causes a loss of moisture in the composite material of the paper. This loss of moisture can lead to deformation or to formation of waves in the paper, which detracts considerably from the appearance and the useful value of the finished printed product. For the prevention of such deformations, it is known to conduct a heat-dried paper web through a re-moistening installation, in which the lost moisture is again supplied. This re-supply of moisture is done with the aid of moistening devices in the form of arrays of spray nozzles, which spray nozzles distribute a fine fog of a water-silicon emulsion on the front and back of the web.

The addition of silicon oil to the water has a number of advantages, among which are an increase in the surface quality of the web, and therefore a reduced friction between the web and guide rollers and formers; and reduced smearing and smear deposition on formers and the folding apparatus, and the like. The extent to which these advantages can be gained depends on the concentration of the silicon oil in the emulsion. The usual practice is to adapt this concentration of silicon oil in the emulsion to such a degree that the above-mentioned advantages can be obtained to the highest possible degree. However, smearing and the deposition of smears cannot completely be prevented. Soiling of the guide rollers of a folding apparatus, on which the moistened web is processed following re-moistening, can be observed even with a carefully optimized additive concentration of silicon oil in the emulsion.

DE 44 05 332 A1 describes a re-moistening system in the cooling roller stand of a web-fed offset printing press. A plurality of moistening devices are assigned to each side of a web.

DE 199 20 091 A1 discloses a re-moistening liquid which includes silicon.

SUMMARY OF THE INVENTION

The object of the present invention is directed to producing a re-moistening installation for an imprinted web of material, and to a method for improving the running properties of a web of material.

In accordance with the present invention, these objects are attained by the provision of a re-moistening installation for an imprinted web of material. A moistening device is provided for the application of a silicon and water emulsion to at least one of the sides of the web. A re-moistening device, for use in an additional application of the emulsion to the web, is spaced from the moistening device or devices at a web distance of at least 5 m. A dosage or concentration of the silicon emulsion may be different at the two emulsion application locations.

The re-moistening installation in accordance with the present invention has the unexpected advantage of accomplishing a reduction of soiling clearly to below the amount of soiling which can be achieved by the careful optimization of the silicon content in a conventional re-moistening installation. A possible explanation of this effect is that, in the case of re-moistening, the emulsion, which is applied in two steps, is distributed in a different way on the web of material than with re-moistening applied in one step. In connection with re-moistening in one step, it is assumed that the applied emulsion penetrates the material in a continuous stream, so that a high degree of surface moisture can only be achieved after the material has absorbed a considerable amount of moisture in its interior, which amount of moisture can be greater than would correspond to the moisture content of the material prior to printing. In a way similar to excessive drying, such excessive moistening of the material can lead to problems in further processing.

With two-stage re-moistening, in accordance with the present invention, the water from the first re-moistening step is initially absorbed by the material, while the silicon oil remains in the area of the surface of the material and partially closes the material's pores. A moisture dosage applied in the second step can therefore not penetrate the material to the same extent. This second moisture dosage therefore remains concentrated on the surface to a great extent, and there improves the surface properties of the material without moistening it in excess in the course of this two step process.

BRIEF DESCRIPTION OF THE DRAWING

The sole drawing figure shows a re-moistening installation in accordance with the present invention, in a greatly schematized section.

DESCRIPTION OF THE PREFERRED EMBODIMENT

A web of material 01, for example a paper web 01, which was dried by heating in a generally known drying installation that is not specifically represented, is initially guided, at the entry to a re-moistening installation, around two rollers 02, for example two first cooling rollers 02, which touch the front and back of the paper web 01, as depicted in the sole drawing figure. The paper web 01, which is pre-cooled in this way, arrives at first and second moistening devices 03, 04, which are arranged at short distances one behind the other along the path of travel of the paper web 01. Each of the first and second moistening devices 03, 04 contains a plurality of spray nozzles 06, which spray nozzles 06 are arranged in a row transversely in respect to the running direction of the paper web 01, and which spray a finely dispersed silicon oil-water emulsion on the first and second sides of the paper web 01, respectively.

The paper web 01, once moistened on both sides by moistening devices 03, 04, then arrives at a second cooling roller arrangement, wherein each side of the paper web comes into contact with at least one second roller 07, for example a second cooling roller 07. The contact of the moistened web 01 with the second cooling rollers 07 aids an even distribution of the emulsion on the paper web 01 and its penetration into the web 01. The purpose of these first moistening devices 03, 04 is essentially to accomplish the compensation of the moisture loss which the paper web 01 had suffered during the previous passage of paper web 01 through the drying installation.

As soon as the water applied by the moistening devices 03, 04 has begun to be distributed in the paper, which, with a customary running speed of the paper web 01, is the case after a paper web path length of at least 5 m, the paper web 01 arrives at two re-moistening devices 08, 09. These two re-moistening devices 08, 09 are structurally identical with the previously described moistening devices 03, 04. However, the re-moistening devices 08, 09 can apply a silicon oil emulsion of a different dosage and/or concentration. This second silicon oil emulsion dosage impinges on a paper surface which had already been enriched with the silicon oil of the first dosage. The second dosage therefore penetrates the paper less rapidly than the first dosage and, at the same time, keeps the paper surface smoother and more slippery than would be possible with single moistening. Because of this two step emulsion application process, the amount of dirt which is deposited on downstream-located rerouting rollers 11, turning bars 12 and other parts of a folding apparatus and the like, which are not specifically represented, is reduced. The possibility of apparatus malfunctions is reduced because of the improved cleanliness, and the maintenance outlay is also reduced.

While a preferred embodiment of a rewetting installation for a material web, and a method for improving the anti-frictional properties of a material web, in accordance with the present invention, has been set forth fully and completely hereinabove, it will be apparent to one of skill in the art that various changes in, for example, the specific structure of the emulsion spray nozzles, the structure of the cooling rollers, and the like could be made without departing from the true spirit and scope of the present invention, which is accordingly to be limited only by the appended claims.

What is claimed is:

1. A re-moistening installation in a printing press for moistening an imprinted material web comprising:

at least a first moistening device adapted to apply a first dosage of a first silicon emulsion having a first concentration to at least a first side of the imprinted material web;

at least a first re-moistening device adapted to apply a second dosage of a second silicon emulsion having a second concentration to at least said first side of the imprinted material web, a web length between said first moistening device and said first re-moistening device both acting on at least the first side of the imprinted material web being at least 5 m, wherein at least one of said first and second dosages and said first and second concentrations is different from the other of said first and second dosages and said first and second concentrations;

a first cooling roller adapted to engage said first side of the imprinted material web and being located after said at least first moistening device and before said at least first re-moistening device along a path of travel of the imprinted material web in the printing press;

a second cooling roller adapted to engage a second side of the imprinted material web and being located after said first cooling roller and before said at least first re-moistening device along said path of travel; and an imprinted material web turning device, said at least first re-moistening device being located between said second cooling roller and said imprinted material web turning device along said path of travel.

2. The re-moistening installation of claim 1 wherein said at least first moistening device is adapted to apply said first silicon emulsion also to said second side of the imprinted material web.

3. The re-moistening installation of claim 1 wherein said at least first re-moistening device is adapted to apply said second silicon emulsion also to said second side of the imprinted material web.

4. The re-moistening installation of claim 1 wherein each of said at least first moistening device and said at least first re-moistening are the same in structure.

* * * * *